US005605453A

United States Patent [19]

Kenner et al.

[11] Patent Number: 5,605,453

[45] Date of Patent: Feb. 25, 1997

[54] BURNER OF A VEHICLE HEATER

[75] Inventors: Erich Kenner, Esslingen; Herbert Langen, Altbach; Wolfgang Schaffert, Aichwald; Peter Reiser, Esslingen, all of Germany

[73] Assignee: J. Eberspächer, Esslingen, Germany

[21] Appl. No.: 571,891

[22] PCT Filed: Aug. 25, 1994

[86] PCT No.: PCT/EP94/02813

§ 371 Date: Dec. 15, 1995

§ 102(e) Date: Dec. 15, 1995

[87] PCT Pub. No.: WO95/06224

PCT Pub. Date: Mar. 2, 1995

[30] Foreign Application Priority Data

Aug. 26, 1993 [DE] Germany ..... 43 28 790.5

[51] Int. Cl.[6] ..... F23Q 7/08

[52] U.S. Cl. ..... 431/262; 237/12.3 C

[58] Field of Search ..... 431/262; 237/12.3 C

[56] References Cited

U.S. PATENT DOCUMENTS 5,197,871 3/1993 Yamamoto et al. ..... 431/262

FOREIGN PATENT DOCUMENTS

| | | |
|---|---|---|
| 2129663 | 12/1971 | Germany . |
| 2912102A1 | 10/1980 | Germany . |
| 3423940 | 1/1986 | Germany . |
| 3713460A1 | 11/1988 | Germany . |
| 3837075A1 | 5/1990 | Germany . |
| 4243712 | 6/1994 | Germany . |

*Primary Examiner*—Carroll B. Dority
*Attorney, Agent, or Firm*—McGlew & Tuttle

[57] ABSTRACT

A burner for a vehicle heating device having a fan or blower for supplying combustion air. A combustion chamber 2 has an inner surface which is provided with a porous lining. A fuel supply line is provided for supplying fuel to the lining. A glow plug ignites the fuel evaporated from the lining. A longitudinal axis of the glow plug has a longitudinal axis which is substantially parallel to a tangential plane of the circumferential wall of the combustion chamber.

19 Claims, 2 Drawing Sheets

BURNER OF A VEHICLE HEATER

FIELD OF THE INVENTION

The present invention pertains to a burner of a vehicle heater and in particular to a burner where liquid fuel is evaporated by a porous lining in a combustion chamber and a glow plug ignites the fuel.

BACKGROUND OF THE INVENTION

The ignition of the fuel in a combustion chamber causes very harsh and adverse conditions which can cause a glow plug to deteriorate. Also byproducts of combustion can accumulate on a glow plug causing fouling and blocking the glow plug from igniting the fuel. In the combustion chamber conditions progress from being almost completely full of liquid fuel, to varying fuel air mixtures, to partial combustion, to full combustion and then to full exhaust. The position of the glow plug is therefore of very great significance for ignition in such burners to avoid deterioration and fouling of the glow plug and still ignite the fuel or fuel-air mixture. The position of the glow plug is also of very great significance for an optimal ignition process in such burners. Previously the glow plug was arranged in a socket projecting radially away from the circumferential wall of the combustion chamber, or it was positioned behind the bottom of the combustion chamber.

SUMMARY AND OBJECTS OF THE INVENTION

The basic object of the present invention is to design the burner with regard to the arrangement of the glow plug such that favorable conditions will be achieved for the ignition, and the glow plug is accommodated in an especially space-saving manner.

To accomplish this object, the burner is characterized according to the present invention in that e) the glow plug is arranged such that it has a plug longitudinal axis located essentially in a tangential plane of the circumferential wall of the combustion chamber.

A large part of the glow area of the glow plug is brought into the favorable vicinity of the interior space of the combustion chamber due to the arrangement of the glow plug. At the same time, especially little space is needed in the environment of the combustion chamber.

The location and the arrangement of the glow plug can also be expressed such that its plug longitudinal axis extends essentially in the tangential direction in relation to the circumferential wall of the combustion chamber, and this should not mean that the longitudinal axis of the glow plug absolutely has to lie in a plane which extends at right angles to the longitudinal axis of the combustion chamber. The longitudinal axis of the glow plug may assume any position in a tangential plane of the circumferential wall of the combustion chamber, and it may even extend in parallel to the longitudinal axis of the combustion chamber in the limiting case, which is even a favorable one. The mounting plane in which the longitudinal axis of the glow plug is located may be shifted somewhat to the inside of the combustion chamber or away from the interior of the combustion chamber in relation to the plane which is mathematically the tangential plane of the circumferential wall of the combustion chamber, as will be shown in the exemplary embodiments described below. The glow area of the glow plug is preferably arranged in an outer side chamber of the combustion chamber, and the side chamber is in connection with the combustion chamber via an opening. The glow plug is thus protected from adverse effects caused by the conditions prevailing in the combustion chamber, especially in terms of exposure to flame and dirt accumulation.

The opening preferably passes through the lining of the combustion chamber, and it is especially favorable for the lining to have a surface area facing the side chamber next to the opening or around the opening. These measures ensure the best conditions for the evaporation of fuel in the immediate vicinity of the glow plug and the formation of a ready-to-ignite fuel-air mixture there.

As an alternative, it is preferable to arrange the glow area of the glow plug in a recessed space of the lining, which is in connection with the combustion chamber via an opening. This also ensures favorable conditions for ignition, on the one hand, and sealing of the glow plug against adverse effects of the conditions prevailing in the combustion chamber.

In a preferred variant of the present invention, the lining, which is designed as a mounted part manufactured as a whole, has a circumferential area and a bottom area. This designing as a mounted part manufactured as a whole, makes possible an especially efficient manufacture and leads to optimal distribution of the fuel being supplied in the lining. Metal netting, metal fabric, sintered metal bodies, and porous ceramic materials are especially suitable materials for the lining or the mounted part. In the case of manufacture from metal netting, metal fabric or the like, it is possible to use especially a disk-shaped blank as the raw material, which is then drawn or compressed to the shape of, e.g., a cup. The lining may also be made from a cut piece. Any openings that may be necessary may be prepared without any problems by, e.g., punching.

At least one intake opening for combustion air is preferably provided in a wall, which is adjacent to the rear side of the lining facing away from the combustion chamber. The combustion air flowing through this intake opening, or intake openings, subsequently passes through the lining and promotes the removal of fuel vapors from the lining into the combustion chamber. The combustion air flowing in there enters the combustion chamber in a finely dispersed form, as desired. Only part of the entire amount of combustion air usually flows into the combustion chamber by this route.

The means for supplying fuel preferably has a fuel supply channel opening to the lining, and this outlet opening should preferably be located at a rather short distance from the point at which the glow area of the glow plug is close to the lining. An especially high degree of saturation of the lining with fuel will thus be attained precisely in the area of the lining which is close to the glow area of the glow plug.

The outlet opening may favorably be located essentially in the same plane of the combustion chamber as the glow plug, and the angular distance between the outlet opening and the point at which the glow area of the glow plug is close to the lining is less than 90° and preferably less than 60°.

To create the best possible conditions for supplying the combustion air, an air supply pre-chamber of the combustion chamber may be provided.

One or more combustion air supply tubes, which open into the air supply pre-chamber, are preferably provided. It is especially favorable for this supply tube or these supply tubes to extend tangentially to a circumferential wall of the air supply pre-chamber.

As an alternative, an essentially axially extending combustion air supply tube, which opens into the air supply pre-chamber, may be provided, and a distributor for generating a swirl component of the air being supplied is preferably provided at the passage between the pre-chamber and the combustion chamber.

The purpose of the described types of supplying combustion air by means of an air supply pre-chamber is to allow combustion air to flow into the combustion chamber with a swirl, which is favorable for complete combustion and for reliable burner operation over a large output range. If a plurality of tangentially arranged combustion air supply tubes are provided, these preferably open, circumferentially distributed, into the pre-chamber.

According to another preferred measure, an essentially tubular combustion chamber insert, which extends farther beyond the site of arrangement of the glow plug in the downstream direction, is provided, and openings for the discharge of combustion air into the space between the combustion chamber insert and the circumferential wall of the combustion chamber are provided in the combustion chamber insert.

A sheathed element glow plug, which is sometimes also called a rod plug, is preferably provided as the glow plug. Unlike conventional glow plugs, sheathed element glow plugs have a sheathed spiral filament. The essentially cylindrical glow plug, which is rounded at its ends, consists of a ceramic or metallic material. The sheathed element glow plug reaches high temperatures very rapidly, and it is less sensitive. In addition, the power consumption per ignition process is lower.

The burner according to the present invention is intended for use in vehicle heaters, especially vehicle heaters for installation in passenger cars, trucks, ships, campers, trailer-type recreational vehicles, bulldozers, etc. If the vehicle heaters are installed in motor vehicles driven by internal combustion engines, the heater may be connected to the liquid circuit, which is usually provided for cooling the internal combustion engine and for heating the interior of the vehicle. The vehicle heater may be, in general, either a so-called water heater, which releases the heat generated to a liquid circuit, or a so-called air heater, which releases the heat generated directly as a warm air flow. Gasoline or diesel fuel may be primarily used as the fuel.

The burner according to the present invention may also be used as a heat generator for the thermal regeneration of particle filters, especially in the exhaust pipes of diesel engines.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
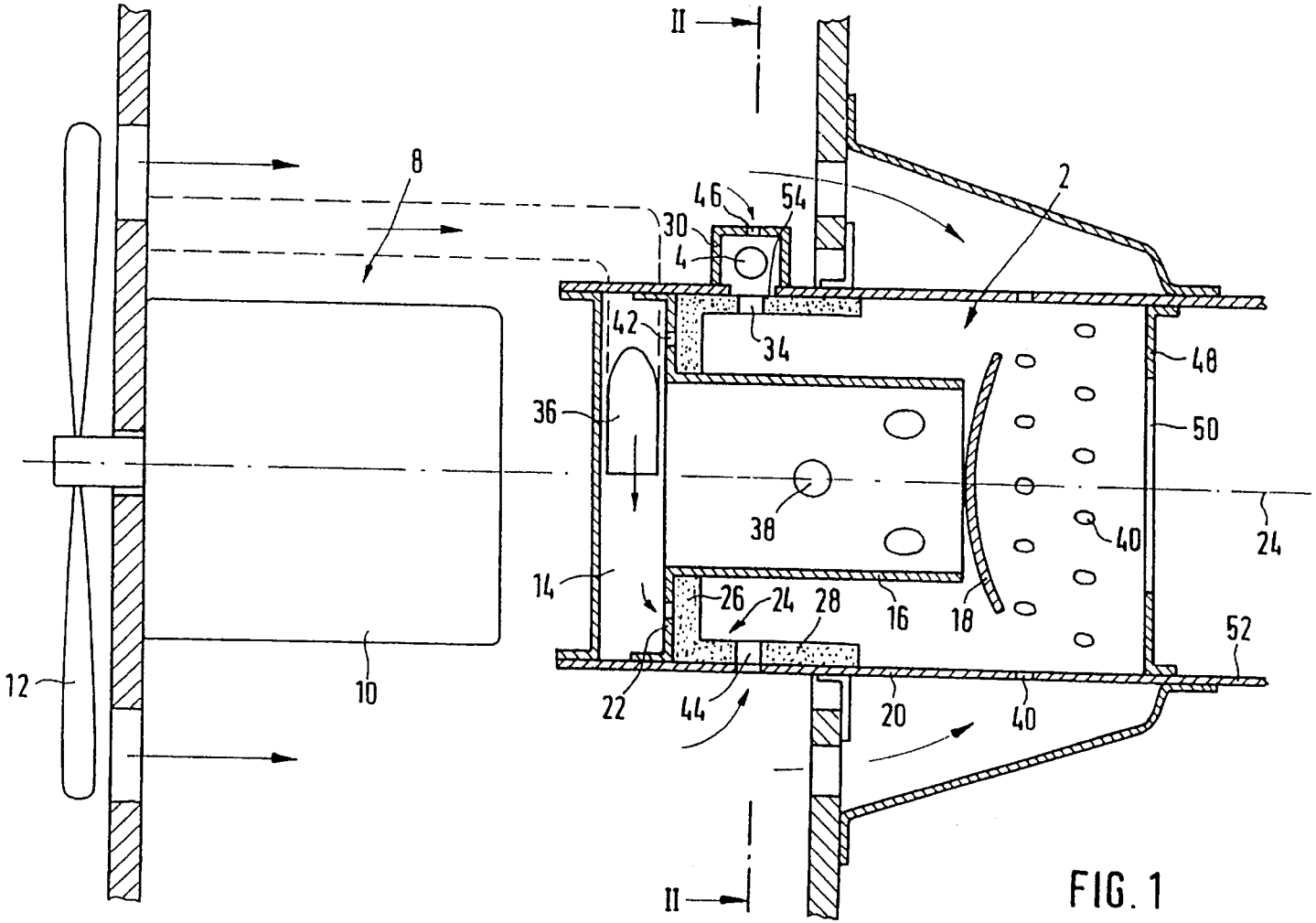
FIG. 1 is a horizontal longitudinal section along I—I in FIG. 2 of the burner area of a vehicle heater.

Referring to the drawings and in particular to FIG. 1, a burner area of a vehicle heater has as its most essential components, a combustion chamber with a glow plug 4 and with a fuel supply means 6, which will be described below, as well as a combustion air blower 8. The housing of the heater is not shown for clarity's sake. In addition, the heater according to FIG. 1 has, joining the combustion chamber 2 on the right, a heat exchanger for transferring heat from the hot combustion gases to a liquid or air.

The combustion air blower 8 comprises an electric motor 10 and a blower impeller 12, which is shown schematically in FIG. 1. Side-channel blowers, which have a stationary channel and a blower impeller rotating at a short distance therefrom, are frequently used in practice.

The combustion chamber 2 is essentially cylindrical in the exemplary embodiment shown. An air supply pre-chamber 14 is arranged in front of the combustion chamber 2 in the left-hand part of FIG. 1. The air supply pre-chamber 14 has the shape of a cylinder with an axial length considerably shorter than the diameter. Beginning from the pre-chamber 14, a tubular combustion chamber insert 16 extends into the combustion chamber 2. The combustion chamber insert 16 is open toward the pre-chamber 14 in the left-hand part of FIG. 1, and it is also open toward the combustion chamber 2 in the right-hand part of FIG. 1. A circular disk-shaped flow-guiding plate 18 is arranged in front of the opening toward the combustion chamber. The circular disk-shaped flow-guiding plate 18 is bent out of its plane and deflects the flow discharged from the insert 16 radially to outward.

An annular partition or end wall 22 extends at right angles to the longitudinal axis 24 of the burner and is located between the insert 16 and the circumferential wall 20 of the combustion chamber 2. A porous lining 24 is arranged on the combustion chamber side joining the partition or end wall 22. The porous lining 24 is as a whole pot-shaped or cup-shaped, and has both a bottom area 26 and a circumferential area 28. The bottom area 26 has such a large central opening that it just fits around the insert 16. The end face of the bottom area 26, which is the left end face of FIG. 1, is in contact with the partition 22. The outer circumferential surface of the circumferential area 28 is in contact with the inner circumference of the combustion chamber 2. The lining 24 is shorter in the axial direction than the insert 16.

The porous lining 24 preferably consists of metal netting, metal braiding, porous sintered metal or porous ceramic material. The lining 24 is a mounted part manufactured as a whole in the exemplary embodiment shown.

Figure 2:
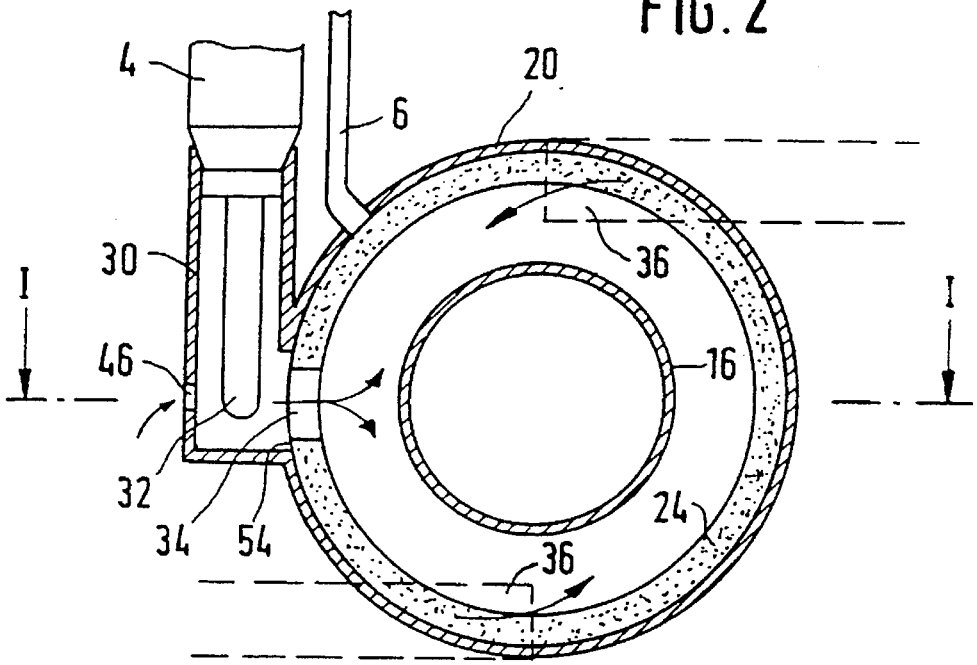
FIG. 2 is a cross section along II—II in FIG. 1 of the area of the burner where the glow plug is positioned.

A tangential or peripheral glow plug socket or plug chamber 30, which extends vertically in the exemplary embodiment shown, is attached laterally to the outer circumference of the circumferential wall 20 of the combustion chamber 2. The socket 30 has a square cross section in the exemplary embodiment shown, but it could also have, e.g., a circular or round cross section. The glow plug 4, designed as a sheathed element glow plug here, is screwed into the socket 30. As shown in FIG. 2, the glow plug 4 has a glow area 32. The plug longitudinal axis of the glow plug extends in a tangential direction with respect to the circumferential wall 20 of the combustion chamber, as it is clearly recognizable from FIG. 2. At the point at which the socket 30 passes over into the circumferential wall 20, the circumferential wall 20 is perforated. The lining 24 also has an opening at this point, but this opening is somewhat smaller than the perforation of the circumferential wall 20. A plug opening 34 is thus formed as a passage between the interior space of the socket 30 and the interior space of the combustion chamber 2.

A first part of the combustion air delivered by the blower 8, enters the pre-chamber 14 via two tubes 36. As is shown especially clearly in FIG. 2, the two tubes 36 extend tangentially to the circumferential wall of the pre-chamber 14 and open at diametrically opposed points. An air flow with a pronounced swirl component is generated in the pre-chamber 14 as a result. The combustion air flows from the pre-chamber 14 into the insert 16. From the insert 16 the combustion air is discharged into the space between the insert 16 and the circumferential wall 20 of the combustion chamber 2 through radial insert openings 38. The combustion air is also partly discharged out of the right-hand end of the insert 16.

Another part of the combustion air flows into the combustion chamber 2 through radial openings which are provided downstream of the insert 16 in the circumferential wall 20 of the combustion chamber 2. Moreover, additional openings for the flow of combustion air are also shown in the drawing, which are preferably present but do not have to be. On the one hand, there are end wall openings 42 in the partition 22. Through these end wall openings 42, relatively small amounts of combustion air can flow into the bottom area 26 of the lining 24, and, finely dispersed, these amounts of combustion air can pass over into the combustion chamber 2. The lining 24 has no larger openings at these points aside from its porosity. On the other hand, there are openings 44 in the circumferential wall 20 of the combustion chamber 2 at points which are reached by the lining 24 with its circumferential area 28, and these openings 44 pass through the lining 24. An inlet opening 46 for a small amount of air into the socket 30 is also present.

A flame diaphragm 48, which has a large central opening 50, is located at the right-hand end of the combustion chamber 2 in FIG. 1. The flame diaphragm 48 is joined, to the right in FIG. 1, by a flame tube 52, in which the combustion of the fuel takes place completely.

As can be recognized from FIG. 2, fuel can be supplied to the lining 24 by means of a fuel supply channel, which is embodied by a fuel line 6, and passes through the circumferential wall 20 of the combustion chamber 2. The point at which the line 6 opens is located in the same cross section plane as the glow area 32 of the glow plug 4, and it is located at an angular distance of 45° from the central axis of the above-described plug opening 34.

When the glow plug 4 is switched on to ignite the burner, fuel evaporates from the lining 24 into the interior of the combustion chamber 2 as well as into the interior of the socket 30, this evaporation being promoted by the heating originating from the glow area 32 of the glow plug 4. A surface area 54 of the lining 24 facing the interior of the socket 30 being additionally beneficial to evaporation. After an ignitable fuel-air mixture has formed, this mixture is ignited in the glow area 32 of the glow plug 4. The ignition propagates through the plug opening 34 into the interior of the combustion chamber 2.

The wall of the socket 30 may, but does not have to, be provided with a porous lining on its inside. However, since the glow area 32 of the glow plug 4 is arranged at a closely spaced location from the lining 24 in the area of the plug opening 34, such a lining of the socket 30 is in many cases unnecessary.

It should be pointed out that more than two combustion air supply tubes 36 may also be provided instead of the two combustion air supply tubes shown in the drawing, or that it is also possible to use only one supply tube 36, which would have a correspondingly increased diameter in this case.

Figure 3:
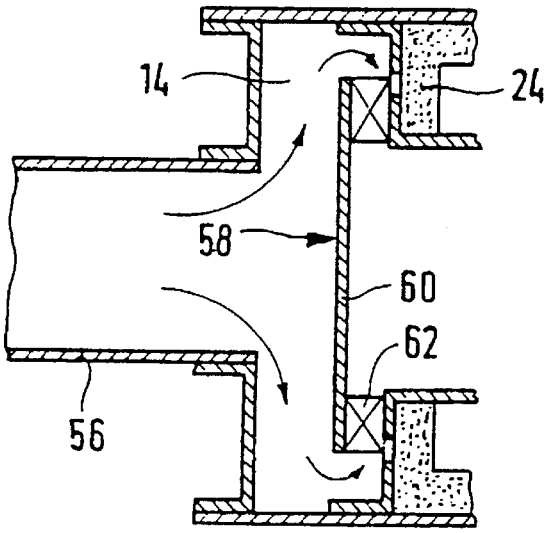
FIG. 3 is a longitudinal section of a partial area of a modified embodiment of the burner.

FIG. 3 shows a modification of the combustion air supply. The combustion air no longer flows into the pre-chamber 14 through tangential tubes, but through an axially extending, central tube 56. A distributor 58 for generating a swirled flow is arranged in front of the inlet opening of the insert 16. The distributor 58 comprises a plate 60 placed in front of the inlet opening of the insert 16 and flow-deflecting surfaces 62. The flow-deflecting surfaces 62 are distributed over the circumference of plate 60 and are arranged between the plate 60 and the partition 22. The deflecting surfaces 62 are placed obliquely in relation to the radial direction such that the desired swirl is generated.

Figure 4:
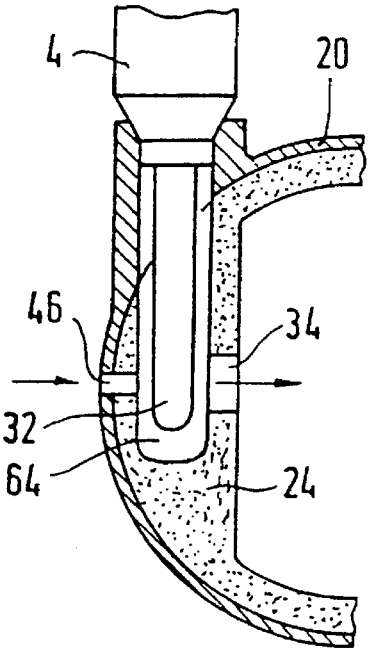
FIG. 4 is a cross section analogous to FIG. 2 of a partial area of a modified embodiment of the burner.

FIG. 4 shows a modified embodiment, in which the glow area 32 of the glow plug 4 is no longer accommodated in a socket 30 arranged outside the circumferential wall 20 of the combustion chamber 2, but in a recess 64 of the lining 24 surrounding the glow area 32 on all sides. Analogously to the above-described exemplary embodiment, an air supply opening 46 to the interior of the recess 64 and a plug opening 34, through which the ignition can propagate into the inside of the combustion chamber 2, can also be recognized. The recess has an approximately cylindrical shape in the exemplary embodiment shown.

The glow plug 4 is also arranged in the exemplary embodiment last described such that its plug longitudinal axis extends in the tangential direction in relation to the adjacent circumferential wall 20 of the combustion chamber. Consequently, the term "tangential direction" does not mean that the glow plug 4 forms a tangent to the circumferential wall 20 in the mathematical sense.

While specific embodiments of the invention have been shown and described in detail to illustrate the application of the principles of the invention, it will be understood that the invention may be embodied otherwise without departing from such principles.

We claim:

1. A burner comprising:

a combustion chamber including a cylindrical wall;

a porous lining positioned on an inner surface of said combustion chamber;

fuel supply means for supplying fuel to said porous lining;

glow plug means for igniting fuel evaporated from said porous lining, said glow plug means including a plug longitudinal axis, said glow plug means being positioned to cause said plug longitudinal axis to be substantially parallel to a tangential plane which is tangential to said cylindrical wall.

2. A burner in accordance with claim 1, wherein:

a plug chamber is attached to a radially outside surface of said combustion chamber, said glow plug means being positioned in said plug chamber;

said cylindrical wall defines a plug opening communicating said plug chamber with said combustion chamber.

3. A burner in accordance with claim 2, wherein:

said plug opening passes through said porous lining.

4. A burner in accordance with claim 2, wherein:

said porous lining has a portion of surface area facing said plug chamber.

5. A burner in accordance with claim 2, wherein:

said porous lining has a portion of surface area facing said plug opening.

6. A burner in accordance with claim 1, wherein:

said porous lining defines a recessed space;

said porous lining defines a plug opening communicating said recessed space with said combustion chamber;

said glow plug means is positioned in said recessed space.

7. A burner in accordance with claim 1, wherein:

said combustion chamber includes an end wall;

said porous lining is mounted on said cylindrical wall and said end wall.

8. A burner in accordance with claim 7, wherein:

said porous lining is a single integral mounted part manufactured as a whole.

9. A burner in accordance with claim 1, wherein:

blower means is provide for supplying combustion air to said combustion chamber;

said end wall defines an end wall opening communicating combustion air from said blower means to said combustion chamber.

10. A burner in accordance with claim 1, wherein:

said fuel supply means includes a fuel supply channel opening to said porous lining at a fuel entry point adjacent said glow plug means.

11. A burner in accordance with claim 10, wherein:

said fuel entry point and said glow pug means are in a same radial plane of said combustion chamber.

12. A burner in accordance with claim 10, wherein:

said fuel entry point and said glow plug means are angularly spaced by less than 90 degrees.

13. A burner in accordance with claim 1, wherein:

an air supply pre-chamber is attached to said combustion chamber.

14. A burner in accordance with claim 13, wherein:

a combustion air supply tube extends tangentially into said pre-chamber.

15. A burner in accordance with claim 13, wherein:

a combustion air supply tube extends axially into said pre-chamber;

said pre-chamber includes a distributer means for generating a swirl component in air from said supply tube.

16. A burner in accordance with claim 7, wherein:

a tubular insert is provided in said combustion chamber and extends axially from said end wall past said glow plug means, said insert defines an insert opening communicating an inside of said insert with a space between said insert and said cylindrical wall.

17. A burner in accordance with claim 1, wherein:

said glow plug means includes a sheathed element glow plug.

18. A burner in accordance with claim 1, wherein:

said glow plug means includes a glow area and said tangential plane is substantially tangential to a portion of said cylindrical wall adjacent said glow area.

19. A burner in accordance with claim 1, wherein:

said glow plug means includes a heated rod element positioned in a mounting plane substantially tangential to a portion of said cylindrical wall adjacent a tip of said rod element.

* * * * *